United States Patent [19]

Sanmi et al.

[11] 4,303,401

[45] Dec. 1, 1981

[54] SUSPENSION MEANS FOR OUTBOARD ENGINES

[75] Inventors: Yasumaru Sanmi; Norimichi Harada; Yasuhiro Nishida, all of Hamamatsu, Japan

[73] Assignee: Yamaha Hatsudoki Kabushiki Kaisha, Iwata, Japan

[21] Appl. No.: 123,576

[22] Filed: Feb. 22, 1980

Related U.S. Application Data

[63] Continuation of Ser. No. 31,972, Apr. 20, 1979, abandoned, which is a continuation of Ser. No. 841,526, Oct. 12, 1977, abandoned.

[30] Foreign Application Priority Data

Oct. 13, 1976 [JP] Japan ..... 51-138056

[51] Int. Cl.[3] ..... B63H 5/12

[52] U.S. Cl. ..... 440/88; 60/310; 123/41.31; 248/640; 440/89

[58] Field of Search ..... 248/640, 642, 643; 123/41.31, 195 A, 198 E; 60/310; 440/900, 88, 89, 76

[56] References Cited

U.S. PATENT DOCUMENTS 2,916,007 12/1959 Kiekhaefer ..... 115/18 X
3,310,022 3/1967 Kollman ..... 115/17

*Primary Examiner*—Sherman D. Basinger
*Attorney, Agent, or Firm*—Donald D. Mon

[57] ABSTRACT

Rubber bushings used in suspending an outboard engine are protected against thermal degradation by cooling them. Preferably the engine exhaust pipe is cooled near a supporting casing further to protect the bushings from overheating.

9 Claims, 4 Drawing Figures

SUSPENSION MEANS FOR OUTBOARD ENGINES

CROSS-REFERENCE TO OTHER APPLICATION

This is a continuation of applicant's co-pending application Ser. No. 31,972, filed Apr. 20, 1979, entitled "Suspension Means for Outboard Engines", (now abandoned) which in turn is a continuation of Ser. No. 841,526, filed Oct. 12, 1977, (now abandoned) with the same title.

FIELD OF THE INVENTION

The present invention relates to a suspension means for outboard motors and, more particularly, to a supporting structure for brackets with which a power unit is secured to the body of a boat.

BACKGROUND OF THE INVENTION

The power unit (which comprises an engine and a supporting casing) is secured to a boat via brackets. The upper portion of the casing is generally heated to a high temperature by the heat of exhaust gas. The brackets and the casing are connected via rubber bushings which serve as buffers for vibration. However, this method causes inconvenience in that the rubber bushings are rapidly deteriorated by the heat and thereby lower the buffering effect.

The object of the present invention is to provide a suspension means for outboard motors, wherein the engine is cooled while preventing the rubber bushings from being rapidly deteriorated. The suspension means of the present invention is characterized in that the rubber bushings are cooled by the cooling water in a water storing chamber provided in the upper portion of the casing of the power unit. The rubber bushings or structure surrounding them are preferably so disposed in the cooling water that they are wholly submerged therein but they may be only partially soaked therein.

Now, an embodiment of the present invention will be explained below with reference to the drawings.

Figure 1:
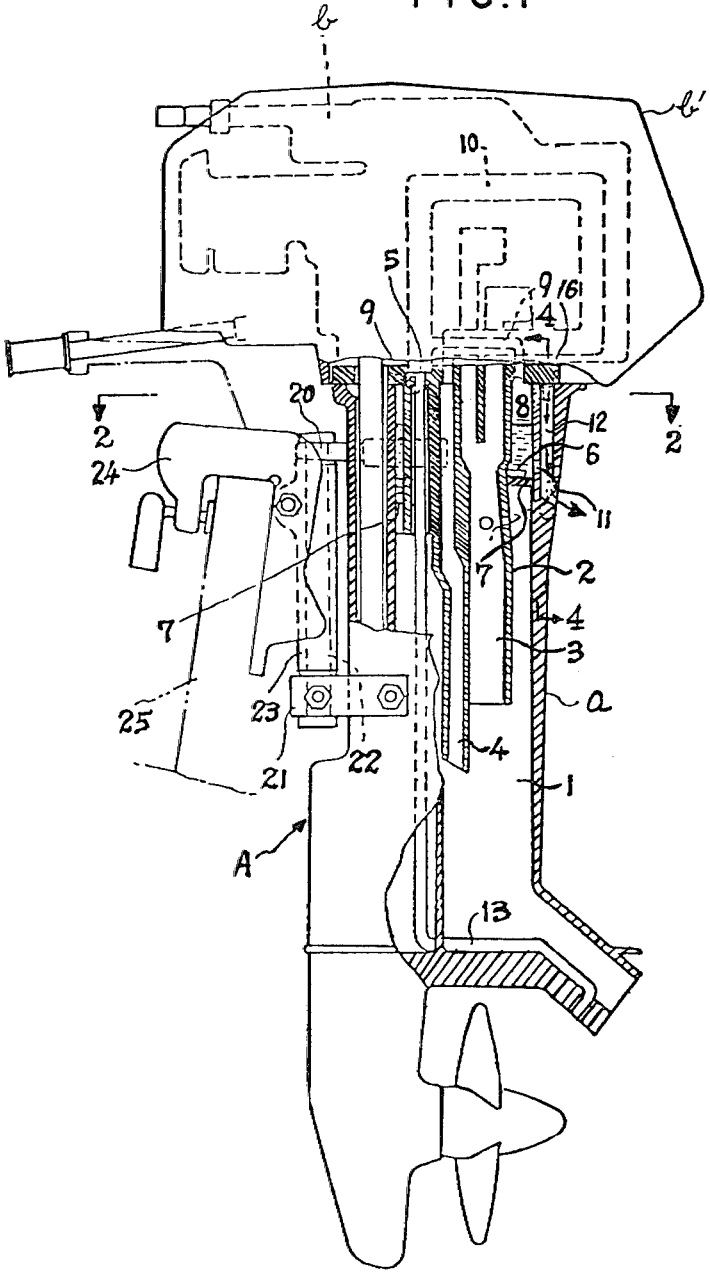
FIG. 1, is a side elevation, partly in vertical cross-section, showing the presently preferred embodiment and best mode of practicing the invention.
Figure 4:
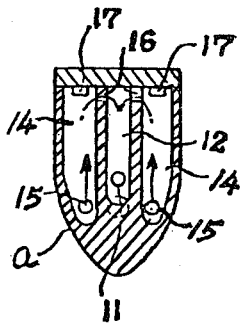
FIGS. 2, 3 and 4 are cross-sections taken at lines 2—2, 3—3 and 4—4, respectively, in FIGS. 1, 2 and 1.
Figure 2:
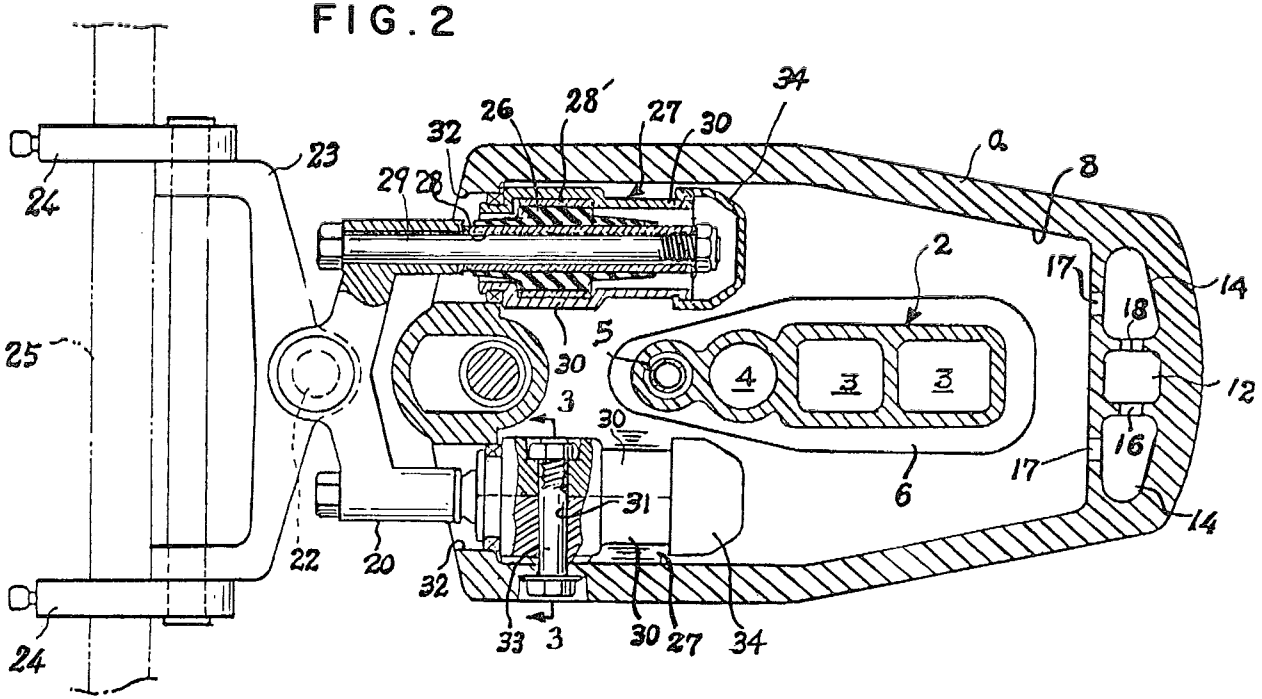
Figure 3:
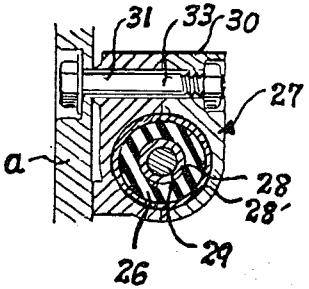

A power unit (A) of an outboard motor consists of a casing (a) and an engine (b) disposed on the upper end thereof, and engine (b) is covered with an engine cowling (b'). In casing (a), a discharge passage (1) is formed, which extends from the upper end of casing (a) to the rear surface of the lower portion thereof. In discharge passage (1), a unit (2) is inserted from the upper end thereof and fixed therein, which consists of an exhaust gas pipe (3), a cooling water discharge pipe (4) and a water suction pipe supporting passage (5) integrally formed.

The unit (2) is provided with a flange (6) integrally formed therewith at such a portion of the circumferential surface thereof that is suitably spaced from the upper end thereof. This flange (6) is placed via a seal in a water-tight manner on a flange (7) projected from the inner surface of discharge passage (1) so as to form a water storing chamber (8) in the upper portion of casing (a). The base portion of exhaust gas pipe (3) is surrounded by this water storing chamber (8) and cooled with the cooling water therein. The water storing chamber (8) is connected to the starting end of a cooling water circulation passage (10) for engine (b) via water passages (9), (9). The cooling water is supplied into water storing chamber (8) through water passages (9), (9). The water storing chamber (8) is communicated via a small hole (11) with an upper discharge passage (12) formed on the upper rear wall of casing (a). A required amount of cooling water can be kept in water storing chamber (8) by discharging cooling water into upper discharge passage (12) through small hole (11), the size of the hole being such as to retain a sufficient volume of water under operating conditions.

Into the cooling water circulation passage (10), cooling water, such as sea-water is supplied via a water suction pipe (13). Pipe 13 is inserted in and is supported in supporting passage (5), and the lower end of this water suction pipe (13) opens through the lower portion of casing (a).

In the drawings, reference numerals (14), (14) denote exhaust gas passages especially for idling, the lower end portions of which are communicated with discharge passage (1) via communication holes (15), (15), and the upper ends of which are communicated with upper discharge passage (12) via communication holes (16), (16). The upper ends of passages (14), (14) are communicated with the upper portion of water storing chamber (8), respectively, via communication holes (17), (17) so that the sound of exhaust gas passing through exhaust gas passages (14), (14) can be muffled by utilizing the volume of water in storing chamber (8). The lower end of cooling water discharge pipe (4) is lower than that of exhaust gas pipe (3) so that the cooling water discharged from discharge pipe (4) is not sucked into exhaust gas pipe (3) even when exhaust gas pipe (3) is at a negative pressure due to the pulsatory motion of exhaust gas.

To the upper portion and intermediate portion of casing (a) as described above, suspension brackets (20), (21) are secured, and, between these brackets (20), (21), a swivel bracket (23) is rotatably provided via a steering shaft (22). On swivel bracket (23), a clamp bracket (24) is provided, which is vertically swingable thereon and which is detachably secured to a transom (25).

The suspension bracket (20) is secured to the upper portions of casing (a) via a support member (27) including a rubber bushing (26). Rubber bushing (26) is of a cylindrical shape having a large diameter portion at the intermediate portion thereof. An inner cylinder (28) and an outer cylinder (28') are integrally fixed on the inner circumferential surface and outer circumferential surface of rubber bushing (26), respectively. The support member (27) consists of rubber bushing (26) fitted on the rear half portion of a support bolt (29) extended from suspension bracket (20), a covering case (30) adapted to be fitted on outer cylinder (28') and covering the outer circumferential surface of bushing (26), and a passage (31) provided on the upper portion of covering case (30), which passage (31) is at right angles with the axis of bolt (29).

The support members (27), (27) are horizontally disposed so that covering cases (30), (30) are at least partially immersed in water in water chamber (8) in casing (a), respectively. When assembling the casing (a), cylinders (28), (28') and covering case (30) are connected with bush (26) inserted between cylinders (28), (28'). The end portions of covering cases (30), (30) are then fitted in a water-tight manner into holes (32) provided in the wall of casing (a). A bolt (33) passed through the side wall of casing (a) is then fitted into passage (31) in covering cases (30), (30) and is with a nut to secure rubber bushings (26) and covering cases (30), (30) to casing (a).

The support bolts (29) the front portions of which are inserted in suspension bracket (20) are thereafter passed through rubber bushings (26), and the rear ends of bolts (29) are tightened with a nut so that the front ends of rubber bushings (26) are pressed against bracket (20). Reference numeral (34) denotes a cap made of rubber.

Thus, the power unit (A) is resiliently suspended from bracket (20) owing to the buffer effect of rubber bushings (26).

The covering cases (30) for support members (27) are wholly or partially soaked in cooling water in water storing chamber (8) thereby to cool rubber bushings (26).

The lower suspension bracket (21) is a member of a conventional construction, and it is fixed on the intermediate portion of the front surface of casing (a) and enclosingly extended to the right and left side surfaces of casing (a). The bracket (21) is secured to casing (a) with bolts via a rubber material inserted therebetween.

Since the suspension means of the present invention is constructed as mentioned above, the rubber bushings are cooled by the cooling water in the water storing chamber in the casing. This cools them to prevent them from being overheated by the heat of the exhaust gas from the engine. Therefore, the present invention can serve to increase the life of the bushing and to provide an outboard motor with long term efficiency.

However, if the base portion of the exhaust gas pipe is disposed in the water storing chamber as in the embodiment, the upper portion of the casing can be prevented from being overheated, and this is desirable for the prevention of the deterioration of the rubber bushings.

In operation, the support members which include the rubber bushing are contacted and cooled by the cooling water. This of course cools the bushings themselves. In a broad sense the support members and the bushings are "bathed" by the cooling water although the rubber bushing in the example is not itself in direct contact with the water. The term "bathed" includes total immersion as well as partial immersion.

This invention is not to be limited to the embodiments shown in the drawings and described in the description which is given by way of example and not of limitation, but only in accordance with the scope of the appended claims.

What is claimed is:

1. Suspension means for outboard motors which include a motor, a casing housing said motor, said casing having a substantial vertical dimension, and requirement for support at an upper portion thereof, said suspension means comprising:

upper and lower brackets for mounting said outboard motor to a boat;

support members including rubber bushings, said upper bracket and said upper portion of said casing being connected to each other by said support members;

cooling water supply means;

a cooling water storing chamber receiving cooling water from said cooling water supply means and having a bottom just beneath the level of the upper bracket and well above the level of the lower bracket, said support members being disposed inside of said water storing chamber and being partially or totally submerged in water therein, whereby to be cooled by said water, said water storing chamber having a wall with a small hole therethrough at an elevation which is above said bottom and also beneath the level of water therein for discharging cooling water from said water storing chamber to the atmosphere, whereby to maintain a flow of cooling water through said chamber.

2. Suspension means according to claim 1 in which cooling water supplied to said water storage chamber has not passed through said motor.

3. Suspension means according to claim 2 in which a gas exhaust pipe from the engine is also cooled by water in the water storage chamber.

4. Suspension means for outboard motors which include a motor, a casing housing said motor, said casing having a substantial vertical dimension, and requirement for support at an upper portion thereof, and an exhaust pipe directed downwardly from said motor through said casing, said suspension means comprising:

brackets for mounting said outboard motor to a boat;

support members including rubber bushings, said brackets and said upper portion of said casing being connected to each other by said support members;

cooling water supply means;

a cooling water storing chamber receiving cooling water from said cooling water supply means, disposed only at the elevation of said upper portion of said casing, said elevation being beneath said motor, and above a substantial vertical extent of said exhaust pipe, said support members being disposed inside of said water storing chamber and being partially or totally submerged in water therein which has been supplied by said cooling water supply means, whereby to be cooled by said water, said water storing chamber having a wall with a small hole therethrough for discharging cooling water from said water storing chamber to the atmosphere, whereby to establish a flow of cooling water through said chamber.

5. Suspension means according to claim 4 in which cooling water supplied to said water storage chamber has not passed through said motor.

6. Suspension means according to claim 5 in which said exhaust pipe from the engine is also cooled by water in the water storage chamber.

7. Suspension means according to claim 4 in which said small hole is at an elevation beneath the level of water in said chamber.

8. Suspension means according to claim 7 in which cooling water supplied to said water storage chamber has not passed through said motor.

9. Suspension means according to claim 8 in which said exhaust pipe from the engine is also cooled by water in the water storage chamber.

* * * * *